United States Patent [19]

Savard et al.

[11] Patent Number: 4,657,587

[45] Date of Patent: Apr. 14, 1987

[54] MOLTEN METAL CASTING

[75] Inventors: Guy Savard, Westmount; Robert Lee, Montreal, both of Canada

[73] Assignee: Canadian Liquid Air Ltd./Air Liquide Canada Ltee, Montreal, Canada

[21] Appl. No.: 799,587

[22] Filed: Nov. 19, 1985

Related U.S. Application Data

[63] Continuation-in-part of Ser. No. 703,751, Feb. 21, 1985, Pat. No. 4,657,587.

[51] Int. Cl.[4] ..... C22B 9/00

[52] U.S. Cl. ..... 75/96; 75/51.5; 75/59.3; 164/66.1

[58] Field of Search ..... 75/96, 51.5, 59.3; 164/66.1

[56] References Cited

U.S. PATENT DOCUMENTS

| | | | |
|---|---|---|---|
| 1,212,825 | 1/1917 | Sheafer | 75/96 |
| 1,227,573 | 5/1917 | Bole | 164/66.1 |
| 1,750,751 | 3/1930 | Geyer | 75/96 |
| 1,978,222 | 10/1934 | Otte | 75/96 |
| 2,092,595 | 9/1937 | Spowers | 75/96 |
| 3,174,200 | 3/1965 | Keel et al. | 164/66.1 |
| 3,392,009 | 7/1968 | Holmes et al. | 75/51.5 |
| 3,451,594 | 6/1969 | Stewart | 164/259 |
| 4,089,678 | 5/1978 | Hanawalt | 75/96 |

OTHER PUBLICATIONS

Barbosa da Silva et al., "Emprego de $CO_2$ na Descarburacao do Aco em Forno Eletrico", *Metalurgia*, vol. 28, No. 172, Mar. 1972, pp. 231–237 (w/transl.).

Nakai et al., "Oxidation Prevention of Molten Steel in Bottom-Casting", *Chem. Abstr.*, vol. 92, 1980, p. 234, 92:114595c.

*Primary Examiner*—Peter D. Rosenberg

*Attorney, Agent, or Firm*—Brown and Neimark

[57] ABSTRACT

Molten steel, normally exposed to an atmosphere of air, is protected against impurities by placing a gas containing a major amount of carbon dioxide gas in such quantities and in such proximity to the surface to cause dissociation of the carbon dioxide at a rate which provides a gas barrier or shroud isolating the steel from the surrounding atmosphere. This method may be applied to protecting certain molten steels being transferred from a ladle to a mold, or from a ladle to a tundish and from the tundish to a mold in continuous casting. In a method where a number of shrouding operations are carried out in series, gas under pressure is bled, in increments, from a storage vessel containing a body of liquid carbon dioxide in an overlying ullage space containing vapor. Each increment is ultimately expanded and dispersed at ambient temperature to form the shroud. As each increment of vapor is removed from the vessel, it is replace by withdrawing liquid carbon dioxide, vaporizing it and returning it to the ullage space.

13 Claims, 5 Drawing Figures

MOLTEN METAL CASTING

This application is a continuation-in-part of application Ser. No. 703,751, filed on Feb. 21, 1985, and now U.S. Pat. No. 4,657,587.

BACKGROUND OF THE INVENTION

1. Field of the Invention

This invention relates to casting molten steel.

2. Description of the Prior Art

In normal practice, molten steel produced by any of the classic processes, for example, the B.O.F., the Q.B.O.P., or the electric furnace process, usually contains a high level of oxygen. This degrades the steel. To overcome this, the steel is killed by introducing into the molten steel deoxidizing agents, for instance, silicon, in the form of ferro silicon or aluminum or both. This is usually performed in a transfer ladle, at tap.

When Al is used the steel is referred to as Al-killed and when Si is used the steel is referred to as Si-killed steel. The non-metallic impurities intentionally formed are allowed to decant and leave the body of molten steel, to be collected at the less dense slag layer floating over the steel.

Following deoxidation treatment, the killed molten steel has a strong affinity for oxygen, which it picks up when exposed to the atmosphere, during pouring from a furnace, or casting into ingot molds, into billets, or into slabs. This results in defects, for example, non-metallic inclusions, in the resulting steel which can reduce the quality of the finished products. For example, inclusions are formed by reaction of elements normally present in steel in concentrations of less than 2%, such as Ca, Mg, Al, Mn, B, Ti, P, Si, Cr, S, with either oxygen or nitrogen. The former are referred to as oxides and the latter as nitrides. When molten steel is exposed to air, formation of both oxides and nitrides can occur.

So, during casting operations and during molten steel transfer stages nearing solidification, new inclusions can be formed if surrounding oxygen or nitrogen is allowed to react with the aforementioned metallic elements. These inclusions, which can be as small as 1 micron and as large as 1000 microns, do not have enough time to float to the surface and, therefore, stay in the body of the solidified steel as non-desirable inclusions.

To prevent or reduce this, various protective methods have been used. One involves shielding open cast steel streams between tundish and mold with ceramic tubes. This has been established practice for maintaining high quality in continuous casting of large bloom and slab sections. It cannot be applied to smaller bloom and billet sections, however, because of space limitations. An example of this type of process is found in Canadian Pat. No. 1,097,881, Thalmann et al, Mar. 24, 1981.

Inert gases such as argon and helium are also well known agents used to protect the molten metal stream or surface during transfer operations. These gases are relatively scarce and, therefore, expensive. Nitrogen gas is presently used when the nitride content is not a critical specification of the finished steel product. More specific expedients are described as follows. The inert gas shrouding of strand cast steel has also been described in the article "Gas Shrouding of Strand Cast Steel at Jones & Laughlin Steel Corporation" by Samways, Pollard & Fedenco, Journal of Metals, October 1974. U.S. patents relating to this method are U.S. Pat. No. 3,908,734, Sept. 30, 1975, U.S. Pat. No. 3,963,224, June 15, 1976, and U.S. Pat. No. 4,023,614, May 17, 1977, all to Pollard.

Another method uses liquid nitrogen to form a shroud about the molten steel as it is teemed into a continuous casting machine. This is described in the brochure entitled "Conspal Surface Protection", published by Concast AG, Zurich, Switzerland, March 1977 and in U.S. Pat. No. 4,178,980 (1979), L'Air Liquide. In general, liquid nitrogen has provided a degree of protection which gives some improvement over other methods. But, handling this substance under the hard conditions of the pouring floor makes it difficult to provide continuity of flow, during the operation. Also, nitrogen has a density close to that of air, reducing its ability to displace air effectively. Moreover, nitrogen inerting is not practicable for grades of steel where nitride formation is undesirable.

The disclosures of the publications and patents mentioned are hereby incorporated by reference.

SUMMARY OF THE INVENTION

The applicants have now found that, surprisingly, carbon dioxide may be effectively employed to form a gas shield in protecting molten steel from oxidation from the atmosphere, for example, in continuous casting, in ingot molding, and in tapping steel from a furnace.

Carbon dioxide has been used in shrouding molten metal like lead, zinc, copper, metals with a melting point lower than the temperature of dissociation of carbon dioxide. From thermodynamic considerations, it would be expected that, on contact of carbon dioxide with molten steel, the latter would be oxidized by the dissociation of the gas, because its dissociation temperature is well below that of molten steel (1550° C. to 1600° C. to 1650° C. up to 1750° C.). However, the applicants have found, unexpectedly, the kinetics are such that on contact with gravitating streams of molten steel, a gas containing a major amount of carbon dioxide at the gas metal interface serves as an effective barrier layer against the surrounding atmosphere. Not only is the oxidation considerably reduced to below the level it would reach if there were no barrier from the atmosphere, inclusions by contact of the molten steel with nitrogen and hydrogen (from moisture in the air) is also prevented. The pick-up of dissociated oxygen from the shrouding gas has been found to be less than about 70 parts per million and may be as low as 20 to 30 parts. The carbon dioxide is thus capable, alone or diluted with non-oxidizing gas, of providing an effective barrier between the molten steel and the surrounding atmosphere which drastically reduces the rate of further oxidation, to the point where this gas can be employed as a most effective shroud to protect molten steel being transferred from one vessel to another from contamination by air.

The use of $CO_2$ differs from the use of inert gases such as argon or helium and that of nitrogen, in that good protection can only be achieved if certain parameters are combined in such manner that the rate of dissociation of $CO_2$ is not allowed to proceed to any significant extent. Under operating conditions typical of inert gas shrouded continuous casting or ingot teeming, some steels may be adversely affected by $CO_2$ shrouding such that the extent of inclusion formation will be higher than if said steel had been shrouded with argon or helium.

Temperature of the $CO_2$ gas and time of exposure are directly related. The shrouding gas is virtually at room temperature when it leaves the gas dispensing equipment or diffuser. By not allowing a stagnant gas to be heated by the metal, the gas is essentially kept below 700° C., preferably below 500° C., by continuous circulation, thus preventing dissociation.

When shrouding a falling stream of molten steel from an upper container to a lower container or mould, the gas should be exposed to the molten metal stream for less than 0.15 seconds, preferably less than 0.10 seconds, and the downward velocity of the gas should be different, i.e. greater or less from that of the metal by at least 5 ft/sec., preferably more than 10 ft/sec.

Where an ingot mold is filled with protective gas most of the contact between the molten metal and the carbon dioxide is at the surface area and any inclusions formed by contact with it would be as slag on the top part of the ingot which would be cut off and discarded. As the steel is poured, the gas would remain pretty well on the surface. If any inclusions were to be formed from carbon dioxide being entrained in the molten metal, they have time to float to the surface of the ingot mold as slag that is ultimately cut off the ingot.

The method described herein is applied to steels containing up to 1% C, up to 1.5% Mn, 0.00 to 0.02% Al, up to 0.05% S, up to 0.4% Si, up to 0.05% P, 0.000% to 0.005% Ti, and 0.000% to 0.005% B. Cu, Ni, Co can be from 0.0% to 1%. There may also be traces of residual metals. The method is particularly appropriate for Si-killed steels for either nails, tubular, structural or sheet metal products.

The lower the partial pressure of $CO_2$, the slower the rate at which dissociation will occur. The partial pressure of the $CO_2$ should be higher than 1.0 atmosphere (104 kPa). The invention contemplates the use of carbon dioxide alone or gas mixtures containing more than 50% $CO_2$ with the balance made up of non-oxidizing gas, for example CO, $N_2$ or inert gases such as argon, helium or one or more of the noble gases.

More specifically, in transferring molten steel from a higher vessel to a lower one, for example, in teeming from a ladle to a mold, an atmosphere of carbon dioxide-containing gas is formed, in a shroud, about the liquid stream, near its source, to form a gaseous blanket which covers the surface of the steel until it solidifies. In the case of top poured ingot teeming into a mold, the mold is flushed, in advance, with the gas to remove the air and provide, in the mold, an atmosphere of the gas into and through which the steel is teemed. In this way, the oxygen content of the mold, prior to teeming, may be reduced substantially to a minimum, for example, to less than 3% by volume, preferably not more than 1%.

The flow rate should be not less than equivalent to about 2.2 cubic meters and preferably as much as 3.4 cubic meters per minute for flushing a mold having a volume of about 100 cubic feet. The lapse time between the end of the purge and the start of the teeming should be kept to a minimum and should not exceed about 35 seconds, and should preferably be between 20 and 30 seconds to insure that the atmosphere of carbon dioxide is substantially intact.

The shroud may be formed by providing a ring, with dispensing openings, about the molten steel stream, near its source at the outlet of the upper vessel, to supply the carbon dioxide in the proximity of the steel stream in the form of jets which merge into a blanket which surrounds the moving surface of the steel stream and is carried along with it. In the case of teeming into an ingot mold, a dispensing ring may surround the outlet nozzle of the teeming ladle. A similar arrangement may be employed, in continuous casting, in the transfer of the steel from the ladle to the tundish, and from the tundish to the mold. In transferring steel from a furnace to a ladle in a stream, appropriate dispensing means may be provided to supply carbon dioxide in proximity to the stream, to shroud it in an analogous manner.

BRIEF DESCRIPTION OF THE DRAWINGS

The invention will be illustrated in more detail by reference to the accompanying drawings, illustrating preferred embodiments, and in which.

DESCRIPTION OF THE PREFERRED EMBODIMENTS

Figure 1:
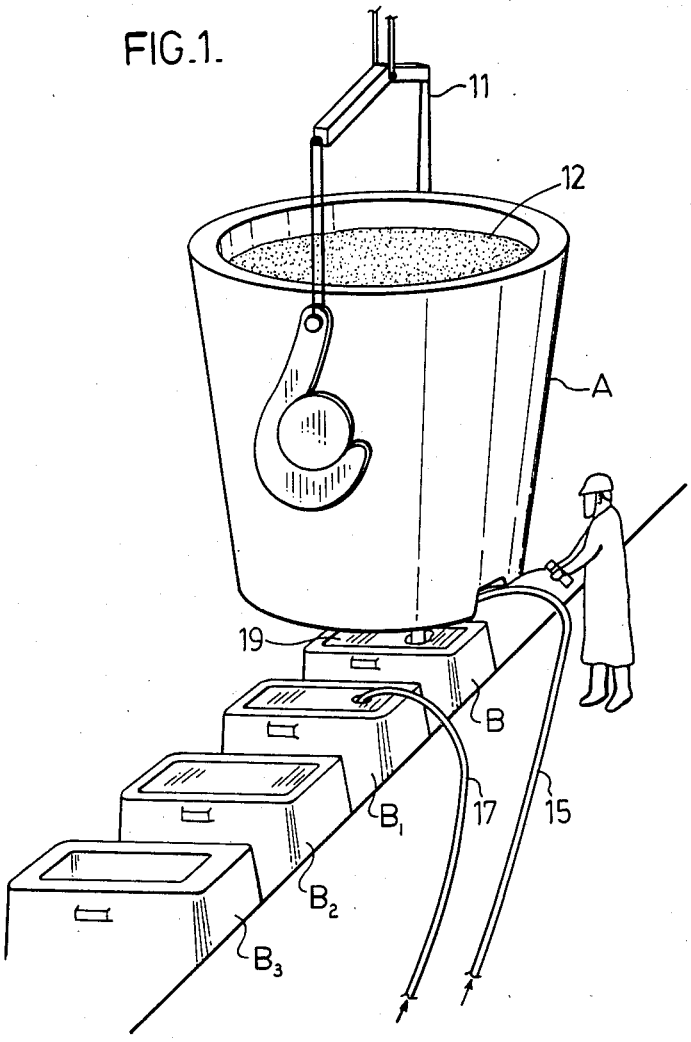
FIG. 1 is a perspective illustration showing the relationship between the ladle and a succession of molds, during the carrying out of a method, according to the invention.
Figure 3:
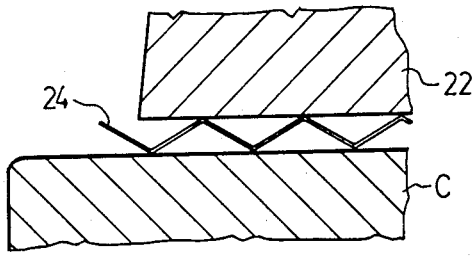
FIG. 3 is an enlarged fragmentary view showing a corrugated steel stand supporting the bottom of the mold.

Referring more particularly to the drawings, FIG. 1 shows a ladle A containing molten steel being teemed into a mold B. A layer 12 of slag tops the molten steel. Carbon dioxide shrouding gas is supplied through a dispensing collar (shown in FIG. 4) through a supply line 15.

A mold $B_1$, waiting its turn for receiving molten steel from the ladle is shown receiving purging carbon dioxide gas through a line 17 and subsequent molds $B_1$ and $B_2$ are awaiting their turn.

An aluminum foil cap 19 sits on top of each mold. The cap 19 is ruptured locally to provide an opening for the gas line.

Figure 2:
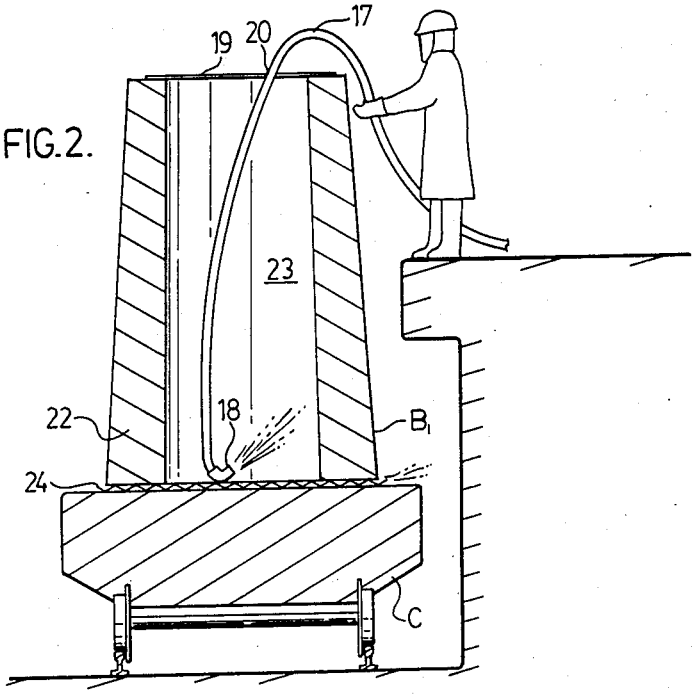
FIG. 2 is a vertical cross-section, partly in elevation, through a mold, in the course of being flushed with carbon dioxide, to prepare it for receiving molten steel from the ladle.

FIG. 2 shows, in more detail, the mold $B_1$, in the course of being flushed with carbon dioxide. The line 17 is passed through an opening 20 in the aluminum foil cap and terminates in a nozzle 18 through which carbon dioxide is dispensed into the bottom of the ladle to displace the air and replace it with an atmosphere of carbon dioxide which is maintained until just before teeming molten metal into that mold.

The mold $B_1$ has a wall 22, enclosing a tapered mold cavity 23. The bottom of the wall 22 sits on a corrugated metal stand 24 supported by the deck of a track mounted stool C to provide a seal between the bottom of the wall 22 and the surface of the deck of the stool C, allowing lateral escape of a certain amount of the carbon dioxide gas. The stool is used to carry the ingots out of the teeming bay.

Carbon dioxide is flushed into the mold $B_1$ until its oxygen content is reduced substantially to a minimum. For example, it has been found possible to reduce the oxygen content to less than 3% and even to not more than 1% by volume. The rate of flow of the flushing gas has to be unexpectedly high to compensate for the conditions encountered, for example, through heat of the mold and leaks beneath the mold at the base and between the top of the mold and the cover. The level of oxygen is maintained at substantially a minimum by continuing the flow of flushing gas just before teeming is started.

Figure 4:
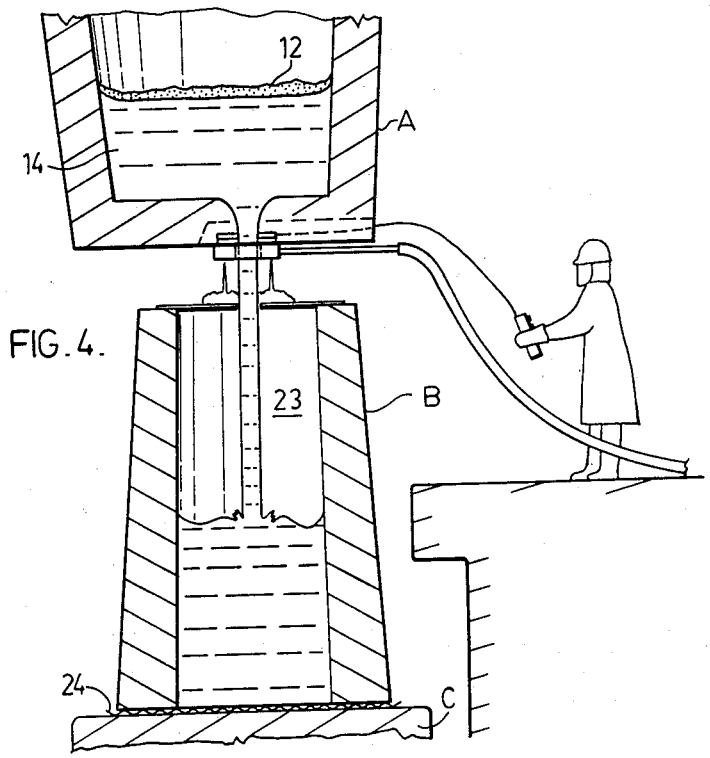
FIG. 4 is a vertical cross-section, partly in elevation, showing the mold and ladle during an ingot teeming operation.

The mold B and the ladle A are brought into teeming position and the teeming operation carried out as will be described in relation to FIG. 4. A slide gate in the mold B is opened by remote control allowing the molten steel to pass down through the outlet passage 25 in the ladle A and passed in the form of a vertical stream S, past a shroud diffuser 27. The stream leaving the ladle outlet 27 is circular in cross-section and of diameter 50 to 100 millimeters and of length between the outlet and $CO_2$ and the mold, which is 45 to 80 centimeters. In the case of continuous casting, the stream from ladle to tundish would have a diameter of about 50 millimeters to 100 millimeters and a length of 30 centimeters to 60 centimeters, whereas the length of the stream from the tundish to the casting mold would be from about 30 centimeters to about 45 centimeters.

The diffuser 27 is fed with gaseous carbon dioxide from a line 15, causing a shroud of gas to surround the stream of molten steel and to be drawn along with it to within the carbon dioxide atmosphere in the mold B. From the time it leaves the outlet of the ladle to the time it reaches its destination in the mold, the molten steel is screened from the atmosphere by a continuous curtain of gas as described above. Once the mold has been filled, the slide gate valve of the ladle is closed to cut off the flow of molten steel and the next mold $B_1$ and the ladle A brought into register for receiving its supply of molten steel.

Figure 5:
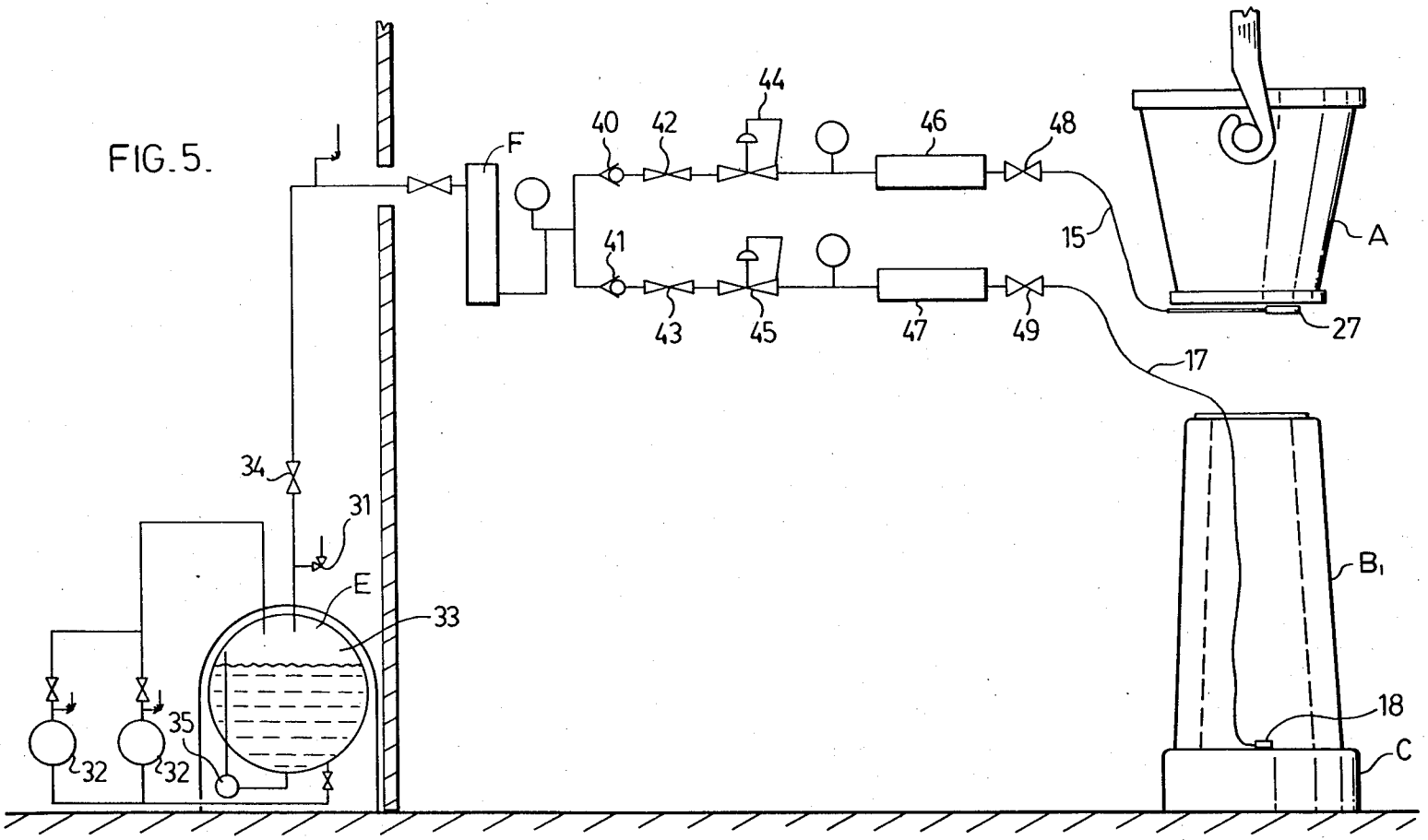
FIG. 5 is a diagram showing the arrangement of pieces of equipment suitable for supplying carbon dioxide for carrying out a method, according to the invention, and the fluid connections between them.

The way in which the carbon dioxide is supplied is important to carrying out a number of shrouding operations one after the other. To this end, a preferred installation, as illustrated in FIG. 5, will be described as follows.

Liquid carbon dioxide is stored in an insulated refrigerated pressure vessel E at a temperature between about 17° and 18° C. and at a pressure of 20 kilos per square centimeter.

The vessel E is protected by a safety pressure relief valve 31, set at 24 kilos per square centimeter. Carbon dioxide is withdrawn as a vapor, from the ullage space 33 of the vessel E, through a block valve 34. Withdrawal of carbon dioxide vapor from the vessel E lowers the pressure in the ullage space 33. A vaporizer 35 is fed from an energy source (electric, hot water or steam) and is provided to vaporize liquid carbon dioxide and maintain the pressure within the ullage space 33 as carbon dioxide is withdrawn through the block valve 34 towards the point of use. Additional vaporizers 32 may be added in parallel to maintain the pressure in the ullage space under conditions of high withdrawl of carbon dioxide vapor through the block valve 34.

There is also a sensor (not shown) which senses the pressure in the ullage space 33. When the pressure falls below that described, then more vapor is supplied to the space 33 to restore the pressure. If the tank is left to stand, for any time, without dispensing vapor the heat increases and thus the pressure. A refrigerator (not shown) is then activated and the vapor cooled down.

Carbon dioxide vapor passes from the ullage space 33 to the block valve 34, at the pressure of the storage vessel (20 kilos per square centimeter) to an inline heater F, fed from an external energy source. It is the purpose of the heater F to add sensible heat to the carbon dioxide vapor so that it is at a temperature where it may subsequently be expanded without producing a temperature outside the operating range of the downstream equipment and which will ultimately dispense carbon dioxide gas at ambient temperature. The temperature to which the gas is heated in the heater may be within the range from 100° C. to 120° C.

The carbon dioxide vapor passes, at this temperature, from the inline heater F through check valves 40 and 41 and block valves 42 and 43 to pressure-reducing regulators 44 and 45. The pressure-reducing regulators 44 and 45 are set to a pressure which will give adequate flow for the downstream requirements.

Flow indicating devices or meters 46 and 47 are provided and the flow of carbon dioxide is controlled by valves 48 and 49. Pressure gauges or indicators 50 and 51 are interposed between the regulators 44 and 45 and the respective meters 46 and 47. The temperature of the gas between the regulators 44 and 45 and the flow indicating devices 46 and 47 will be in the range from about 5° C. to about 15° C.

EXAMPLE 1

For the purpose of this example, equipment was employed substantially as shown in the drawings and operated substantially as described above. A ladle was employed, having a capacity of 120 tonnes and molds each having a volume of approximately 100 cu. ft. and a capacity of 8 to 9 tonnes so that each 120 tonne heat yielded 6 to 9 ingots. The ladle had a circular outlet or nozzle of diameter from 5 to 6.5 cm. Each mold produced ingots 270 cm. tall and had rectangular sections averaging 70×160 cm. The distance from the bottom of the outlet to the top of the mold was 75 cm. Each mold rested on a track-mounted stool (base plate) which is used to carry the solidified ingots out of the teeming bay.

The ladle was equipped with a perforated ring, just below the outlet, capable of forming a protective shroud of carbon dioxide gas. This ring was connected to a continuous source of supply of carbon dioxide gas as shown in FIG. 5. In addition, conventional apparatus was available for flushing the mold with carbon dioxide gas.

While the steel was in the furnace, the molds were being prepared for teeming, according to the following procedure. A strong jet of compressed air was applied to the stool to remove any loose particles. A coating dispersion, consisting of cement in dilute phosphoric acid was then applied to the stool. Four strips of corrugated steel sheet about 6″×30″×1/16″ were placed in a square or oblong pattern on the stool to provide a stand. When the mold was placed in position on the stand, its weight deformed the corrugation to reduce the chances of molten steel leakage (see delay in FIG. 2).

An oblong well made of light gauge steel sheet measuring approximately 20″×40″×50″ was placed on the stool inside the mold to reduce the intensity of splashing when the first molten metal was teemed into the mold. Exothermic "boards" ("hot tops") were fixed on the top 12″ of the inside of the mold which, upon contact with the molten steel, generate heat that slows down the rate of cooling at the top of the ingot, thereby reducing the depth of the "pipe" in the top of this ingot which must be cropped before subsequent rolling. A cover of aluminum foil was placed on top of the mold to limit the exposure to atmosphere before the mold had been purged with carbon dioxide.

Air was displaced from inside the mold by carbon dioxide purging at a rate of 2.25 to 120 scfm for approximately 3 to 5 minutes before teeming each ingot. An asbestos protected rubber hose was introduced into the mold through the aluminum foil in such a way that the diffuser reached as far down as possible, as illustrated in FIG. 2. The flow of gas was continued until the air had been expelled from the mold, to the point where the oxygen concentration in the mold was not more than 1% by volume. The flushing continued until just prior to the teeming into that mold, to take care of gas leak between the mold and its stool.

At the start of teeming, the molten steel perforated a small hole in the aluminum foil, thus reducing the amount of ambient air drawn into the mold.

The temperature of the steel in the stream was within the range from 1625° C. to 1650° C.

During teeming to each mold, a shroud of carbon dioxide was formed near the source of the stream, i.e. just below the bottom of the ladle underneath the nozzle. The shroud formed about the stream of molten steel was entrained with it and formed a protective gas barrier from the atmosphere from the time it left the nozzle to the point of impact in the mold. The flow rate of carbon dioxide to the shroud was 2.8 cubic meters per minute.

The ladle containing the 120 tonnes of steel was positioned over the already purged first mold and the shroud gas flow was started. The purge hose had been transferred to the second mold without interrupting the gas flow.

The slide gate was opened to start teeming. The nozzle, at times, is blocked by either frozen metal or slag. In either case, oxygen lancing is required to clear the nozzle.

Although $CO_2$ was supplied in liquid form, gaseous $CO_2$ was used at both injection points (flushing and shrouding). A system was therefore employed which ensured a vaporization capability to provide a flow rate comparable to that of an inert gas, for example, argon. A $CO_2$ supply set-up similar to that shown in FIG. 5 was used.

The first ingot took the least time to fill since the metal head gradually decreased during teeming. In approximately 3 minutes, the mold was filled and the slide gate was closed (for about 20–30 seconds) while the overhead crane operator positioned the ladle over the second mold. The purging gas hose had meanwhile been transferred to the next mold and the slide gate reopened to fill the mold that had just been purged. The sequence was continued until the ladle was emptied of its metal charge.

It was found that there was no significant increase over 1% oxygen by volume resulting in the first 45 seconds after carbon dioxide purging. The elapsed time between the end of the purge to the start of teeming averaged not more than 30 seconds with the exception of the first ingot which took slightly longer, but less than 45 seconds, because of the oxygen lancing of the teeming nozzle.

The charge in each mold was allowed to cool, in the classic way, with a protective flux on the surface, to form a solid ingot. The molds were then stripped from the ingots.

Quality of Steel

Each ingot was hot rolled into skelp, according to standard practice, and tested for surface defects. The acceptable skelp was then rolled into sheet and the sheet made into spirally welded pipe. The pipe was then subjected to sonic testing to reveal defects.

Control heats were then carried out, in an identical manner, using argon and carbon dioxide as shown in the table below.

The gas flow in the case of carbon dioxide was 2.8 cubic meters per minute and argon 2.8 cubic meters per minute. Each mold was flushed for about 3 minutes and the stream of molten metal was protected for the duration of the teeming operation, about 25 minutes.

A comparison of the results follows in terms of surface defects on skelp rolled from billets produced.

| Shrouding | Mold Flushing | Rejection rate % by Weight |
|---|---|---|
| Argon | Argon | 0.7 |
| Carbon dioxide | Carbon dioxide | 0.55 |
| Argon | Carbon dioxide | 0.43 |
| Defects by Sonic Test on spiral welded pipe: | | |
| Argon | Argon | 0.4 |
| Carbon dioxide | Carbon dioxide | 0.15 |
| Argon | Carbon dioxide | 0.00 |

EXAMPLE 2

The following example is of a shrouding procedure which is ineffective.

$CO_2$ shrouding of continuously cast Si-killed steel of a composition 0.20 C, 0.8 Mn, 0.03 S, 0.20 Si and 0.01 Ti will result in a larger inclusion count than if the steel were cast without any shroud, that is, exposed to air.

EXAMPLE 3

The following is an example of an effective shrouding procedure.

$CO_2$ shrouding of continuously cast Si-killed steel of composition 0.06 C, 0.46 Mn, 0.025 S, 0.14 Si, less than 0.01 Al and less than 0.001 Ti resulted in a metal containing at the most an equal amount of inclusions than for the case of argon shrouded with the same steel.

Advantages

Because of the relatively low cost of carbon dioxide gas and its ready availability, as compared, for example, with argon or nitrogen, its non-toxicity as compared with CO, for example, and the fact that the gas can be generated locally and supplied continuously makes it a most useful gas when used as described herein. Carbon dioxide is heavier than air (1.3:1) as against argon (1.37:1) and will therefore maintain an effective protective shroud longer than lighter gases because it will not disperse into the atmosphere as readily.

In carrying out a number of shrouding operations one after the other, despite the heavy drain on the carbon dioxide supply and its expansion when dispensed, the expedients described which differ from that of dispensing other shrouding gas, make it possible to maintain the gas at a temperature at which the equipment is protected and the carbon dioxide does not freeze.

The amount of oxygen in the starting steel, being teemed, would depend on the grade of steel and could amount to 400 parts per million to 1,900 parts per million, or in specialized steels or continuous casting it can be as low as 40 parts per million. In a normal teeming operation, without shrouding, one would expect the oxygen pick-up in the steel to be in the hundreds of parts per million by volume. When the mold is flushed and the steel stream is shrouded with carbon dioxide, in accordance with the invention, the pick-up is not more than 70 ppm and can be as low as 20 to 30 ppm.

We claim:

1. A method of protecting a body of steel from the atmosphere as it passes therethrough as a gravitating liquid stream, comprising, placing a gas containing a major amount of carbon dioxide in contact with the molten steel in such quantities as to form a shroud providing a barrier between the steel and the atmosphere, the steel containing up to 1% C, up to 1.5% Mn, 0.00 to 0.02% Al, up to 0.05% S, up to 0.4% Si, up to 0.05% P, 0.000 to 0.005% Ti, 0.000 to 0.005% B, and 0.0 to 1.0% of each of Cu, Ni and Co, the gas being exposed to the molten steel for less than 0.15 seconds and the gas kept at a temperature below 700° C.

the gas stream being dispersed so that its downward velocity differs from that of the molten metal by at least 5 feet per second and the partial pressure of the carbon dioxide is not higher than 1 atmosphere.

2. A method, as defined in claim 1, in which the steel is transferred from a ladle to a mold to form an ingot, and the mold is first flushed with said gas to displace air and provide therein an atmosphere of gas, then the stream of molten steel is teemed into the gas filled mold under the protection of a shroud of said gas whereby the molten steel is protected from the atmosphere by a barrier of gas from the time it leaves the ladle until its surface solidifies.

3. A method, as defined in claim 1, in which liquid steel is continuously cast by passing it through an atmosphere of air, in the form of a free flowing stream, from a ladle to a tundish and in further free flowing stream from a tundish to a mold, comprising, shrouding with said gas in proximity to the surface of both streams of molten steel.

4. A method, as defined in claim 1, in which the oxygen pick-up of the steel is less than 70 parts per million.

5. A method, as defined in claim 2, in which the oxygen content of the mold is less than about 3% by volume when teeming is commenced.

6. A method, as defined in claim 1, in which the gas is carbon dioxide.

7. A method, as defined in claim 1, in which the gas is a mixture of more than 50% carbon dioxide and non-oxidizing gas.

8. A method of shrouding molten steel, at a temperature within the range from 1550° C. to 1750° C., from the atmosphere as it flows from an upper container to a lower one as a liquid stream while a protective gas is continuously flowed to form a shroud about the stream, in which the steel contains up to 1% C, up to 1.5% Mn, 0.00 to 0.02% Al, up to 0.05% S, up to 0.4% Si, up to 0.05% P, 0.000 to 0.005% Ti, 0.000 to 0.005% B, and 0.0 to 1.0% of each of Cu, Ni and Co, the protective gas is selected from the group consisting of carbon dioxide and a mixture of more than 50% carbon dioxide and at least one non-oxidizing gas, the velocity of the gas as it meets the steel differs substantially from the velocity of the steel stream.

9. A method, as defined in claim 8, in which the gas is carbon dioxide.

10. A method, as defined in claim 8, in which the steel is exposed to the shrouding gas for less than 1.5 seconds.

11. A method, as defined in claim 8, in which the velocity of the gas, as it meets the steel, differs at least 5 feet per second from the velocity of the surface of the steel.

12. A method, as defined in claim 1, in which the pick up of oxygen by the steel is less than 70 parts per million.

13. A method, as defined in claim 8, in which the flow rate of the gas is between about 2.2 to 3.3 cubic meters per minute.

* * * * *